US011821701B2

(12) United States Patent
Septfons et al.

(10) Patent No.: US 11,821,701 B2
(45) Date of Patent: Nov. 21, 2023

(54) COMPACT GUIDE DEVICE FOR A RECOILING MASS

(71) Applicant: NEXTER SYSTEMS, Versailles (FR)

(72) Inventors: Pierre Septfons, Bourges (FR); Patrick Balbo, Bourges (FR)

(73) Assignee: NEXTER SYSTEMS, Versailles (FR)

( * ) Notice: Subject to any disclaimer, the term of this patent is extended or adjusted under 35 U.S.C. 154(b) by 0 days.

(21) Appl. No.: 17/918,805

(22) PCT Filed: May 3, 2021

(86) PCT No.: PCT/IB2021/053689
§ 371 (c)(1),
(2) Date: Oct. 13, 2022

(87) PCT Pub. No.: WO2021/224762
PCT Pub. Date: Nov. 11, 2021

(65) Prior Publication Data

US 2023/0143482 A1 May 11, 2023

(30) Foreign Application Priority Data

May 4, 2020 (FR) ..... 2004166

(51) Int. Cl.
*F41A 25/22* (2006.01)

(52) U.S. Cl.
CPC ..... *F41A 25/22* (2013.01)

(58) Field of Classification Search
CPC ..... F41A 25/22; F41A 25/24; F41A 25/02; F41A 25/04

(Continued)

(56) References Cited

U.S. PATENT DOCUMENTS 2,125,892 A * 8/1938 Dabrasky ..... F41A 21/00 89/37.07
2,273,878 A * 2/1942 Magrum ..... F41A 25/18 89/37.14

(Continued)

FOREIGN PATENT DOCUMENTS

EP 0 321 345 A1 6/1989
EP 0 747 651 A1 12/1996

(Continued)

OTHER PUBLICATIONS

Jan. 14, 2021 Search Report issued in French Patent Application No. 2004166.

(Continued)

*Primary Examiner* — John Cooper
(74) *Attorney, Agent, or Firm* — Oliff PLC

(57) ABSTRACT

A weapon system includes a recoiling mass and a cradle, the recoiling mass including a weapon barrel and a breech ring and translating relative to the cradle during firing, and a guide device being provided for guiding this recoil movement of the recoiling mass. This weapon system is characterized in that the guide device includes at least one bar that is secured to the cradle and extends to the rear of the weapon system, the bar cooperating with at least one rail carried by the breech ring. The breech ring is connected to the cradle by two pairs of hydraulic or pneumatic recoil brakes, each rail being arranged between two brakes of the same pair, the body of each brake being secured to the breech ring.

5 Claims, 3 Drawing Sheets

(58) Field of Classification Search
USPC ..... 89/163, 198, 199, 14.3, 160, 162
See application file for complete search history.

(56) References Cited

U.S. PATENT DOCUMENTS

| | | | | |
|---|---|---|---|---|
| 2,966,829 | A * | 1/1961 | Tannenbaum | F41A 25/18 89/44.01 |
| 4,269,109 | A * | 5/1981 | Stoner | F41A 3/82 89/44.01 |
| 4,991,490 | A * | 2/1991 | Balbo | F41A 19/57 89/27.13 |
| 5,703,318 | A * | 12/1997 | Franchino | F41A 25/22 89/36.02 |
| 6,347,568 | B1 * | 2/2002 | Soulaigre | F41A 25/22 89/42.01 |
| 7,971,517 | B2 * | 7/2011 | Eagleston | F41A 25/22 89/37.14 |
| 8,448,561 | B2 * | 5/2013 | Carroll, III | F41A 23/60 89/37.03 |
| 2012/0266747 | A1 * | 10/2012 | Wynes | F41A 5/36 89/43.01 |

FOREIGN PATENT DOCUMENTS

| | | |
|---|---|---|
| EP | 1 072 857 A1 | 1/2001 |
| FR | 2 679 990 A1 | 2/1993 |

OTHER PUBLICATIONS

Jan. 14, 2021 Written Opinion issued in French Patent Application No. 2004166.

Aug. 13, 2021 International Search Report issued in International Patent Application No. PCT/IB2021/053689.

Aug. 13, 2021 Written Opinion of the International Searching Authority issued in International Patent Application No. PCT/IB2021/053689.

* cited by examiner

COMPACT GUIDE DEVICE FOR A RECOILING MASS

The invention relates to a weapon system comprising a recoiling mass and a cradle.

The recoiling mass of a weapon typically comprises a weapon barrel, which is equipped at its rear part with a breech ring.

The breech ring carries the breech, which closes the barrel after the piece of ammunition has been loaded. The breech may be a wedge breech or a screw breech.

During firing, the recoiling mass translates relative to the cradle to allow the recoil of the weapon barrel after the piece of ammunition has been fired.

It is therefore necessary to provide a means for guiding this recoil.

Patent EP 1,072,857 describes an example of a guide means comprising prismatic shoes that are secured to the cradle and slide in corresponding grooves carried by a carriage to which the weapon barrel is fixed.

The disadvantage of such a solution is that a carriage must be fitted to the recoiling mass, which affects the bulk of the weapon system.

In addition, in order to reduce the recoil forces and recoil length, it is necessary to give a large mass to the recoiling mass.

Patent application US 2012/0266747 A1 is another example of the implementation of such a carriage, and in particular describes a weapon system with damped recoil comprising a recoiling mass that slides relative to a cradle, the recoiling mass comprising a weapon barrel and a breech, there being provided a pair of recoil brakes, secured to the cradle and connected to one another by brackets. The recoiling mass is guided relative to the cradle by means of bars that are secured to the cradle and receive rails carried by a carriage secured to the weapon barrel.

Also known from patent application U.S. Pat. No. 5,703,318 A is a weapon system comprising a recoiling mass, including a breech ring and a weapon barrel, and a cradle, guiding being provided by bars that are carried by the breech ring and slide in rails secured to the cradle. Recoil brakes and recuperators are provided, all being housed in the cradle.

It is the aim of the invention to propose a weapon system in which both the recoil forces are reduced and the mass of the cradle is reduced.

This makes it possible for the weapon system to be lighter with reduced forces at the trunnions.

The invention thus relates to a weapon system comprising a recoiling mass and a cradle, the recoiling mass comprising a weapon barrel and a breech ring and translating relative to the cradle during firing, and a guide means being provided for guiding this recoil movement of the recoiling mass, the weapon system being characterized in that the guide means comprises at least one bar that is secured to the cradle and extends to the rear of the weapon system, the bar cooperating with at least one rail carried by the breech ring, the breech ring being connected to the cradle by two pairs of hydraulic or pneumatic recoil brakes, each rail being arranged between two brakes of the same pair, the body of each brake being secured to the breech ring.

In a particular embodiment, the ring may be extended at its front part by at least two wings, the at least one guide rail extending along the wings.

Advantageously, each bar may carry a shoe with a prismatic profile engaged in a complementary profile carried by the corresponding rail of the breech ring.

In a particular embodiment, the prismatic profile of the shoe may comprise at least two pairs of bearing surfaces each delimiting a V shape, the two V shapes being positioned facing each other.

In a parallel manner, the rail of the breech ring may comprise at least two pairs of bearing surfaces complementary to those of the shoe and each delimiting a V shape, the two V shapes being positioned facing each other.

The invention will be better understood upon reading the following description of a particular embodiment, the description being made with reference to the attached drawings in which.

Figure 1:
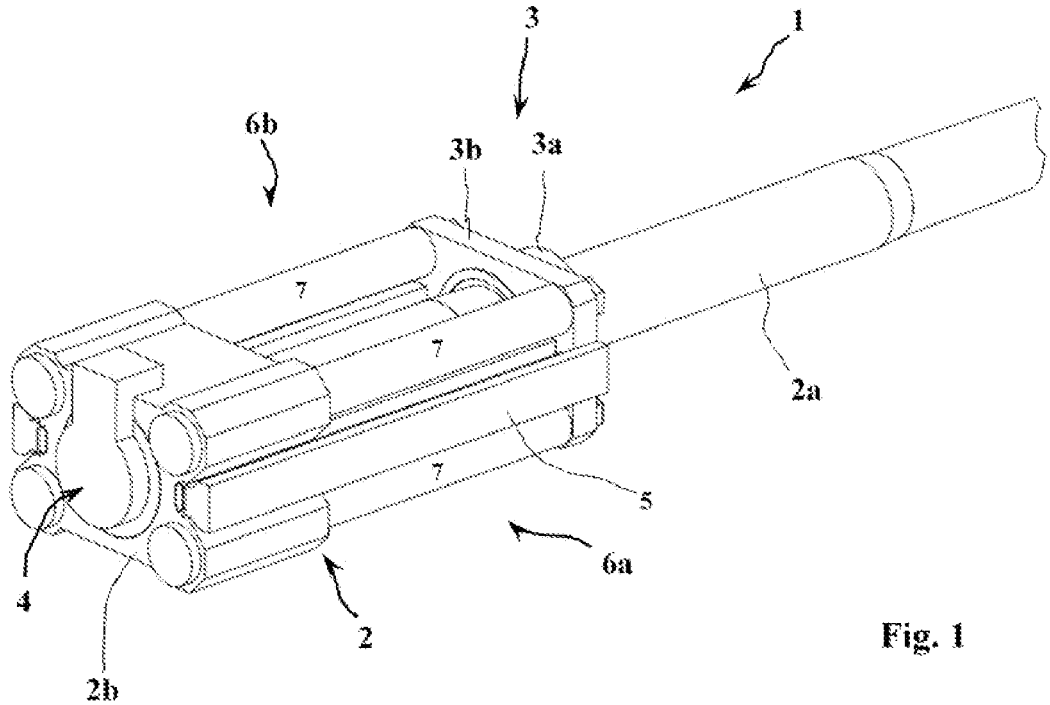
FIG. 1 shows a rear perspective of a weapon system according to one embodiment of the invention, with the recoiling mass in the return to battery position.
Figure 2:
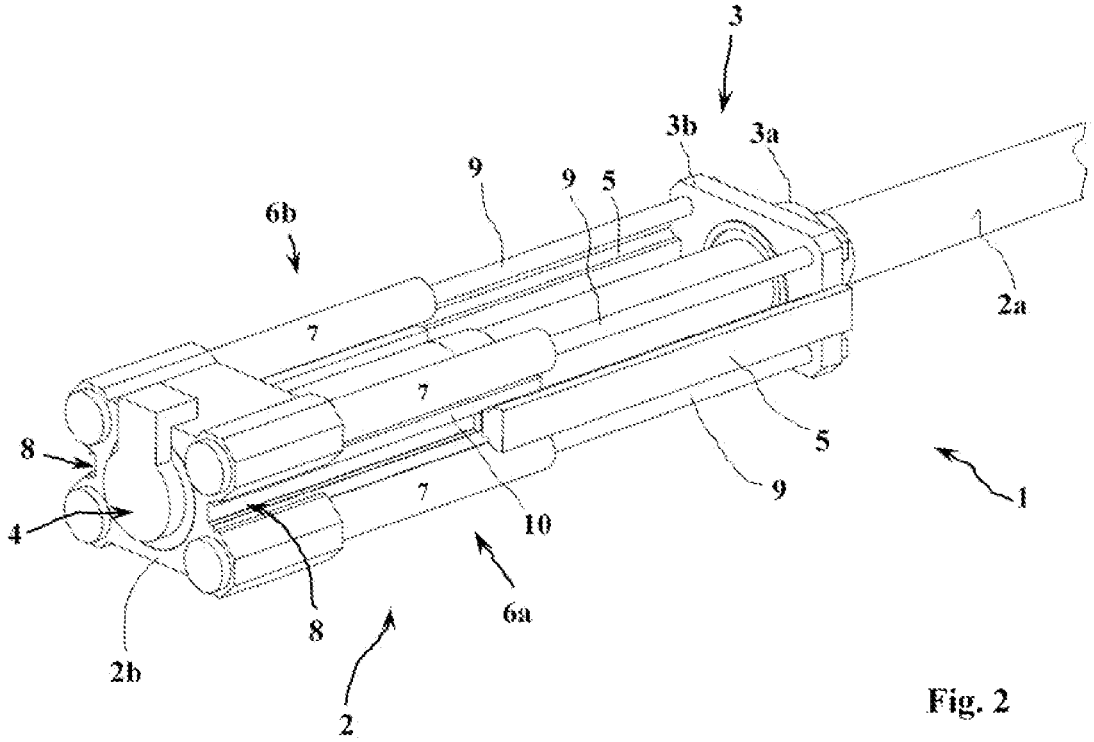
FIG. 2 shows a rear perspective of the same weapon system with the recoiling mass in the maximum recoiling position.

Referring to FIGS. 1 and 2, a weapon system 1 according to one embodiment of the invention comprises a recoiling mass 2 and a cradle 3.

This weapon system is for example intended to equip an armored vehicle, which is not shown, for example a tank.

The cradle 3 is connected to the turret of the vehicle by a system of trunnions (not shown) allowing the weapon system to be aimed in elevation. These mountings are conventional and are therefore not shown here.

In a similarly conventional manner, the recoiling mass 2 comprises a weapon barrel 2*a* to which a breech ring 2*b* is fixed. For example, the weapon barrel 2*a* will be of a large caliber, such as a barrel with a caliber greater than 105 mm.

The breech ring 2*b* that is shown is a ring that carries a breech closure by means of a screw 4 engaged in an axial tapered thread of the ring.

Screw breeches are well known to the one skilled in the art, for example by patent FR 2,679,990, and it is not necessary to describe them in detail.

It would also be possible to provide a breech ring carrying a wedge breech of the type described for example in patents EP 747,651 and EP 321,345.

As can be seen from the Figures, the cradle 3 has a ring 3*a* in which the weapon barrel 2*a* slides.

The ring 3*a* carries an end plate 3*b* and it is extended by two bars 5.

The breech ring 2*b* is connected to the cradle 3 by an elastic linkage that comprises recoil brakes 7 and one or more recuperators (not shown). The hydraulic recoil brakes 7 are well known and generally comprise a piston moving in a cylinder and causing the expulsion of a fluid, most often oil. The throttling of the oil causes braking. Pneumatic brakes are also known, but the braking efficiency is lower.

The function of the recuperators is to return to battery the recoiling mass 2 after its recoil. When the brake is hydraulic, the fluid expelled from the brake is led through pipes to the recuperator where it compresses a gas whose expansion will lead to the return to battery of the recoiling mass.

Figure 5:
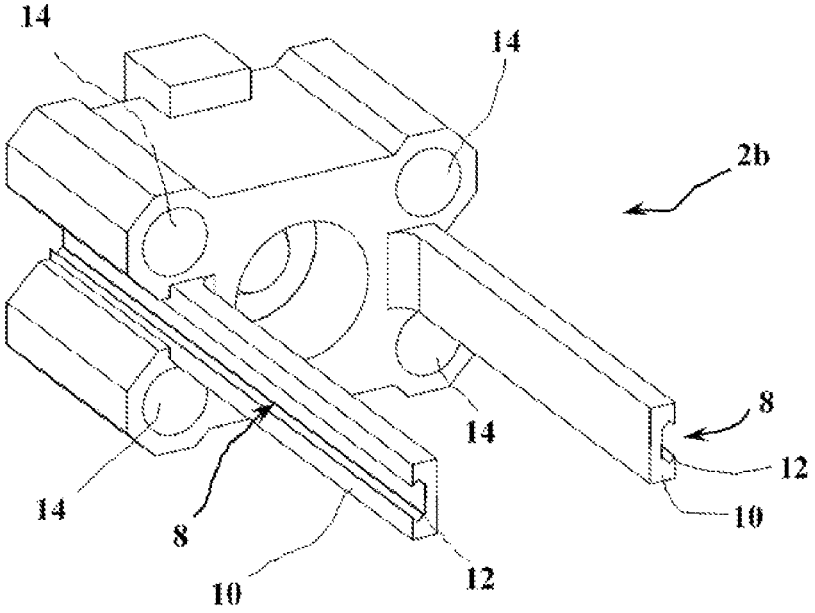
FIG. 5 is a perspective view of the ring alone.

The weapon system 1 shown in the Figures comprises two pairs 6*a*, 6*b* of hydraulic or pneumatic recoil brakes 7. The body of each brake 7 is secured to the breech ring 2*b*, for example by screwing or shrink-fitting, and is positioned in a complementary cylindrical housing 14 of the ring 2*b* (FIG. 5). The rod 9 of each recoil brake is fixed by screwing to the end plate 3*b* of the cradle 3 (FIG. 2).

Each bar 5 secured to the cradle 3 extends to the rear of the weapon system, and cooperates with at least one rail 8 carried by the breech ring 2*b*. As it can be seen in FIG. 2, each rail 8 is arranged between two brakes 7 of the same pair 6*a*, 6*b*.

In order to ensure that guiding is provided over the entire recoil length, and as it can be seen in particular in FIG. 5, the ring 2*b* is extended at its front part by at least two wings 10, and the one ore more guide rails 8 extend along the wings.

Figure 3:
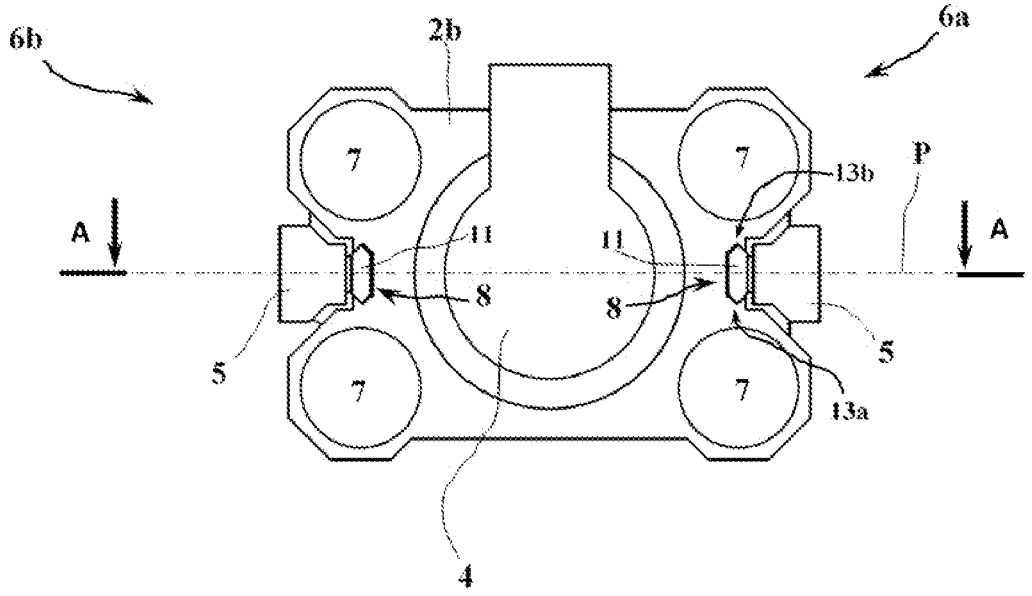
FIG. 3 is a rear view of the weapon system according to this embodiment of the invention.
Figure 4:
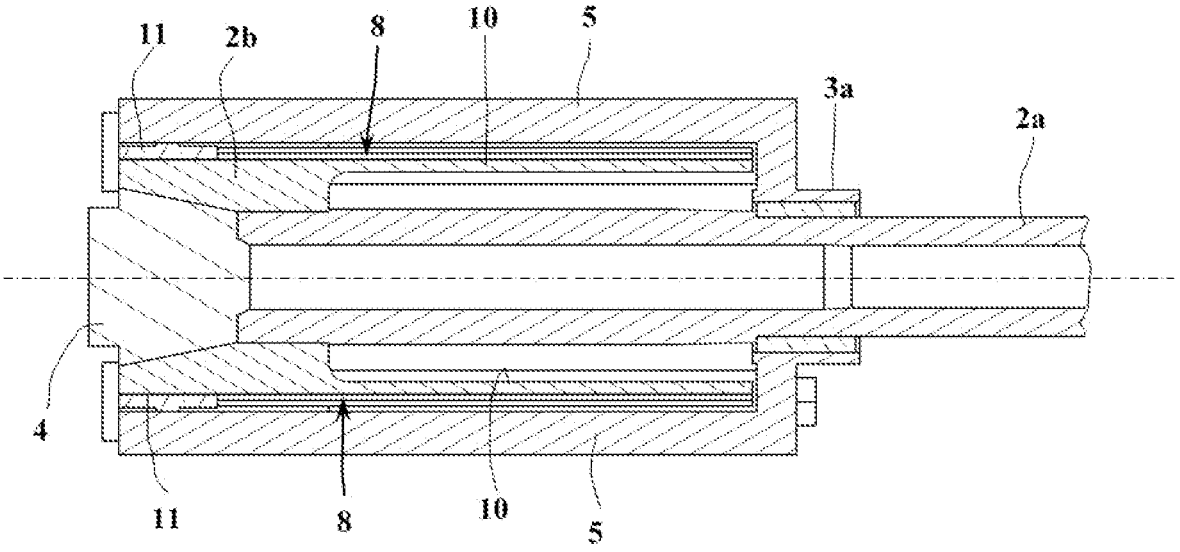
FIG. 4 is a longitudinal cross sectional view of the weapon system according to this embodiment of the invention, the section being made along the plane whose trace AA is indicated in FIG. 3.

As it can be seen more particularly in FIGS. 3 and 4, each bar 5 carries at its rear end a shoe 11 with a prismatic profile, which is engaged in a complementary profile 12 (FIG. 5) obtained by machining and that forms the corresponding rail 8 of the breech ring 2*b*.

A prismatic external profile is a polyhedron shape based on two equal and parallel polygons whose homologous sides are joined by parallelograms.

In simple terms, a prismatic shape has a non-circular section and whose section is constant along the prism. It therefore allows sliding along the axis of the prism (the line connecting the barycenters of the two equal and parallel bases) and prohibits any rotation around the axis of the prism. A rectangular parallelepiped is a prism (rectangular base). A shoe whose section is a regular or non-regular hexagon (as shown in the figures) is also a prism.

As it can be seen clearly on FIG. 3, the prismatic profile of the shoe 11 comprises at least two pairs 13*a* and 13*b* of bearing surfaces, each of which delimits a V shape. The two V shapes thus formed are positioned facing each other, symmetrically with respect to the plane P, which is the plane of symmetry of the shoes and which also contains the axis of the weapon barrel 2*a*.

In order to receive this shoe 11, the profile 12 of the rail 8 of the breech ring 2*b* comprises at least two pairs of bearing surfaces which are complementary to the bearing surfaces 13*a* and 13*b* of the shoe 11. They also each delimit a V shape, the two V shapes thus formed being positioned facing each other.

A possible shape for the shoes 11 is described in patent EP 1,072,857, to which reference may be made for further details. It should be noted that this patent also describes an adjustment device to compensate for wear, which can advantageously be implemented here.

It can therefore be seen that, with the invention, the recoiling mass 2 also includes the mass of the bodies of the brakes 7.

Thus, this increases the overall mass of the recoiling mass 2, which reduces both the recoil forces and the recoil length. Such an arrangement is favorable to an integration in the turret of an armored vehicle and to an overall reduction in the mass of the weapon system, the cradle of which no longer has to be oversized.

The recoiling mass 2 translates from the cradle 3 during firing due to the recoil effect.

The translation movement is guided, on the one hand, by the cooperation of a cylindrical bearing surface of the weapon barrel 2*a* with the ring 3*a* of the cradle 3 and, on the other hand, by the sliding of the two shoes 11 on the profiles 12 of the rails 8 which are secured to the breech ring 2*b*.

It can be seen that the guide means here are particularly compact and that it is not necessary to provide additional rails on either side of the recoiling mass.

The structure of the recoiling mass incorporates the guide means formed by machining the profiles 12 of rails 8 on the breech ring 2*b* itself. No dedicated carriage is required, as the breech ring 2*b* carries, within its structure, part of the guide means.

An embodiment has been described, in which the bars 5 have guiding shoes 11. It would also be possible to provide the bars 5 themselves with the prismatic profile that cooperates with the rails 8.

The invention claimed is:

1. Weapon system comprising a recoiling mass and a cradle, the recoiling mass comprising a weapon barrel and a breech ring and being arranged to translate with a recoil movement relative to the cradle during firing, and a guide means being provided for guiding this recoil movement of the recoiling mass, wherein the guide means comprises at least one male bar that is secured to the cradle and extends to a rear of the weapon system, the at least one male bar cooperating with at least one female rail carried by the breech ring, the breech ring being connected to the cradle by two pairs of hydraulic or pneumatic recoil brakes, each of the at least one female rail being arranged between two recoil brakes of a same pair and being located in a plane comprising said pair of recoil brakes, a body of each recoil brake being secured to the breech ring.

2. The weapon system according to claim 1, wherein the breech ring is extended at a front part thereof by at least two wings, the at least one female guide rail extending along the at least two wings.

3. The weapon system according to claim 1, wherein each of the at least one male bar carries a shoe with a prismatic profile engaged in a complementary profile carried by the corresponding female rail of the breech ring.

4. The weapon system according to claim 3, wherein the prismatic profile of the shoe of each of the at least one male bar comprises at least two pairs of bearing surfaces each delimiting a V shape, the at least two V shapes being positioned facing each other.

5. The weapon system according to claim 4, wherein each of the at least one female rail of the breech ring comprises at least two pairs of bearing surfaces complementary to those of the shoe of a respective male bar and each pair of bearing surfaces delimiting a V shape, the at least two V shapes being positioned facing each other.

* * * * *